US007999481B2

(12) United States Patent
Ono et al.

(10) Patent No.: US 7,999,481 B2
(45) Date of Patent: Aug. 16, 2011

(54) LIGHTING METHOD FOR A HIGH-PRESSURE DISCHARGE LAMP, LIGHTING CIRCUIT FOR A HIGH-PRESSURE DISCHARGE LAMP, HIGH-PRESSURE DISCHARGE LAMP APPARATUS, AND PROJECTOR-TYPE IMAGE DISPLAY APPARATUS

(75) Inventors: Syunsuke Ono, Osaka (JP); Minoru Ozasa, Kyoto (JP); Masahiro Yamamoto, Osaka (JP); Go Yamada, Osaka (JP)

(73) Assignee: Panasonic Corporation, Osaka (JP)

( * ) Notice: Subject to any disclaimer, the term of this patent is extended or adjusted under 35 U.S.C. 154(b) by 380 days.

(21) Appl. No.: 12/443,819

(22) PCT Filed: Jul. 10, 2008

(86) PCT No.: PCT/JP2008/001860

§ 371 (c)(1),
(2), (4) Date: Mar. 31, 2009

(87) PCT Pub. No.: WO2009/008175

PCT Pub. Date: Jan. 15, 2009

(65) Prior Publication Data

US 2010/0013399 A1 Jan. 21, 2010

(30) Foreign Application Priority Data

Jul. 12, 2007 (JP) ..... 2007-183628

(51) Int. Cl.
*H05B 37/02* (2006.01)

(52) U.S. Cl. ..... 315/224; 315/307; 315/308

(58) Field of Classification Search ..... 315/224, 315/307, 308, DIG. 5, DIG. 7, 209 R, 246, 315/247

See application file for complete search history.

(56) References Cited

U.S. PATENT DOCUMENTS

| | | | | |
|---|---|---|---|---|
| 6,943,503 | B2 | 9/2005 | Ozasa et al. | |
| 7,365,951 | B2 * | 4/2008 | Sun et al. | 361/72 |
| 7,469,940 | B2 * | 12/2008 | Sun et al. | 315/308 |
| 7,479,742 | B2 * | 1/2009 | Matsui et al. | 315/291 |
| 2002/0105288 | A1 | 8/2002 | Nakagawa et al. | |

FOREIGN PATENT DOCUMENTS

| | | |
|---|---|---|
| EP | 1 309 228 | 5/2003 |
| JP | 2003-338394 | 11/2003 |
| WO | 2006/051926 | 5/2006 |

* cited by examiner

*Primary Examiner* — David Hung Vu

(57) ABSTRACT

After startup, a lighting method for a high-pressure discharge lamp is to light the lamp at a rated frequency without switching the frequency for 120 seconds (S12, S13), and thereafter to switch from the rated frequency to a more audible frequency in accordance with a change in voltage value (S21 to S23).

14 Claims, 8 Drawing Sheets

[Fig. 1]
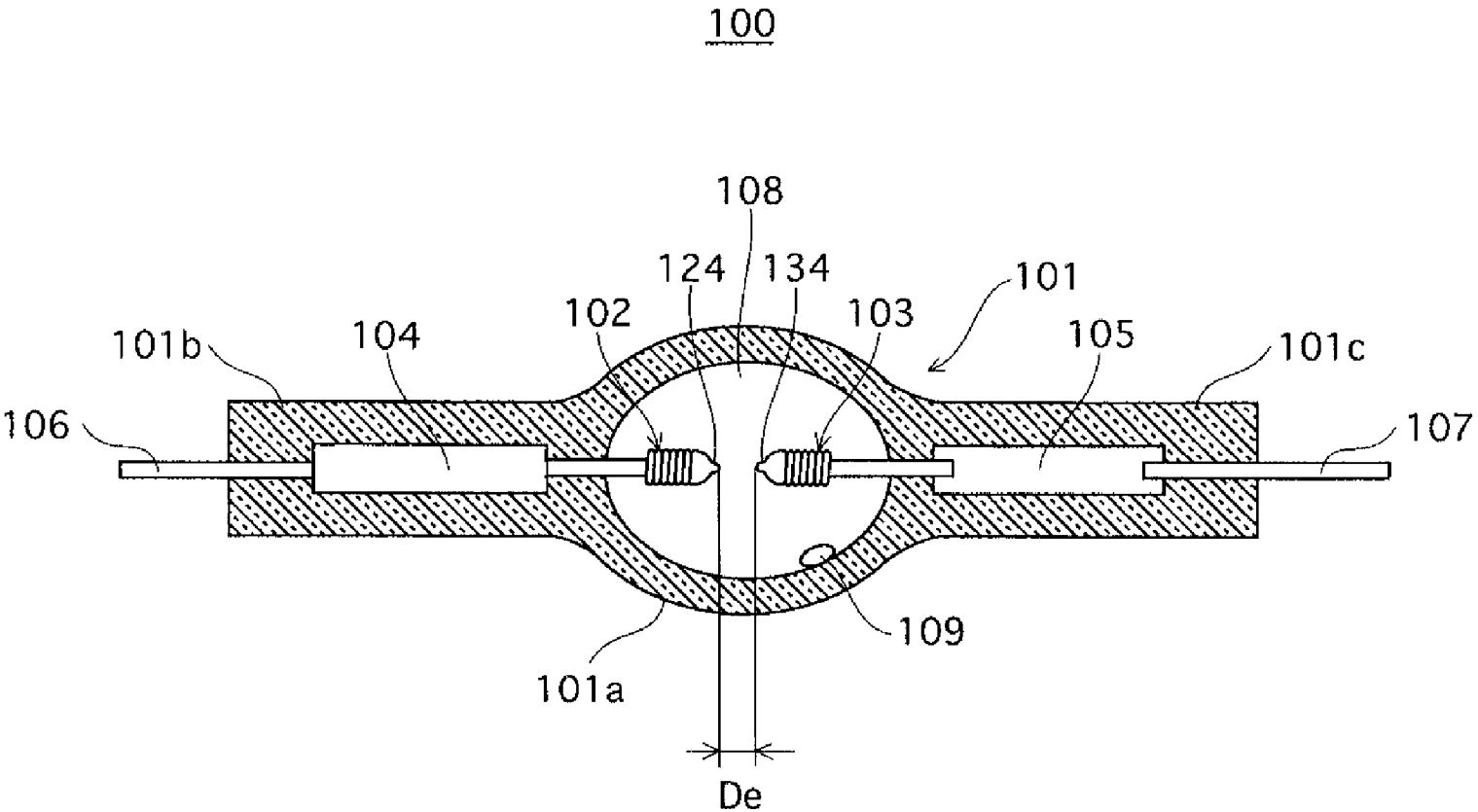

[Fig. 2]
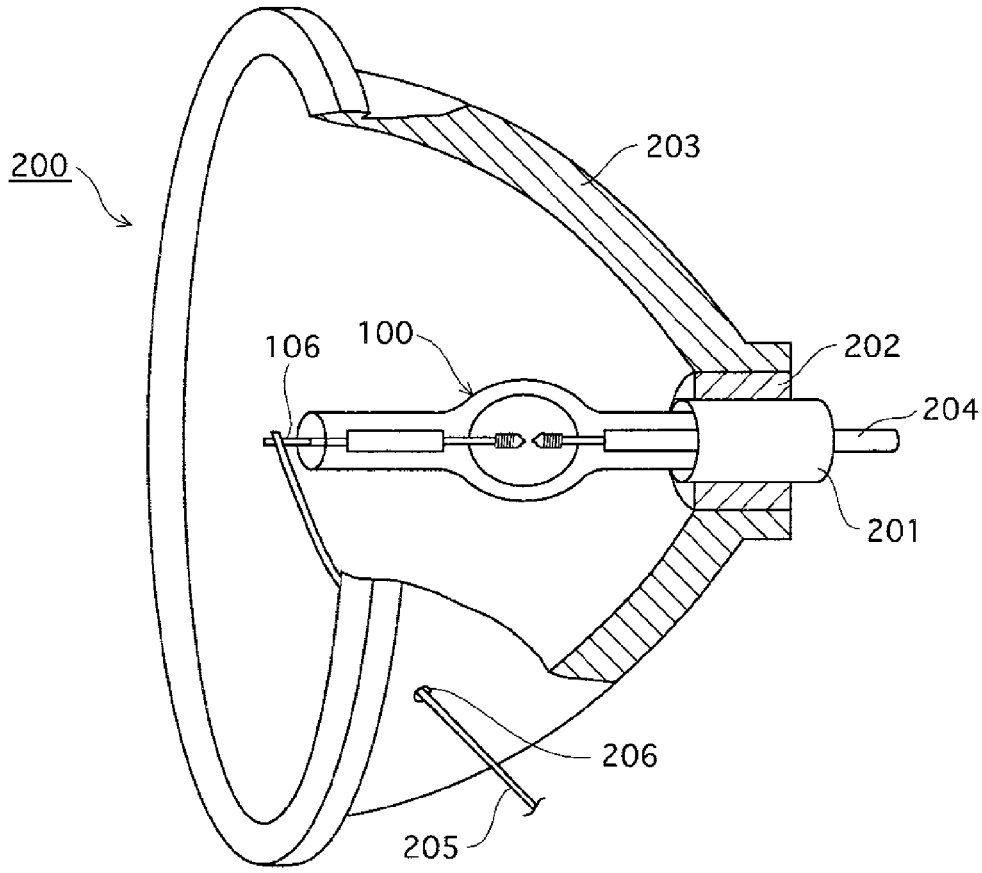

[Fig. 3]
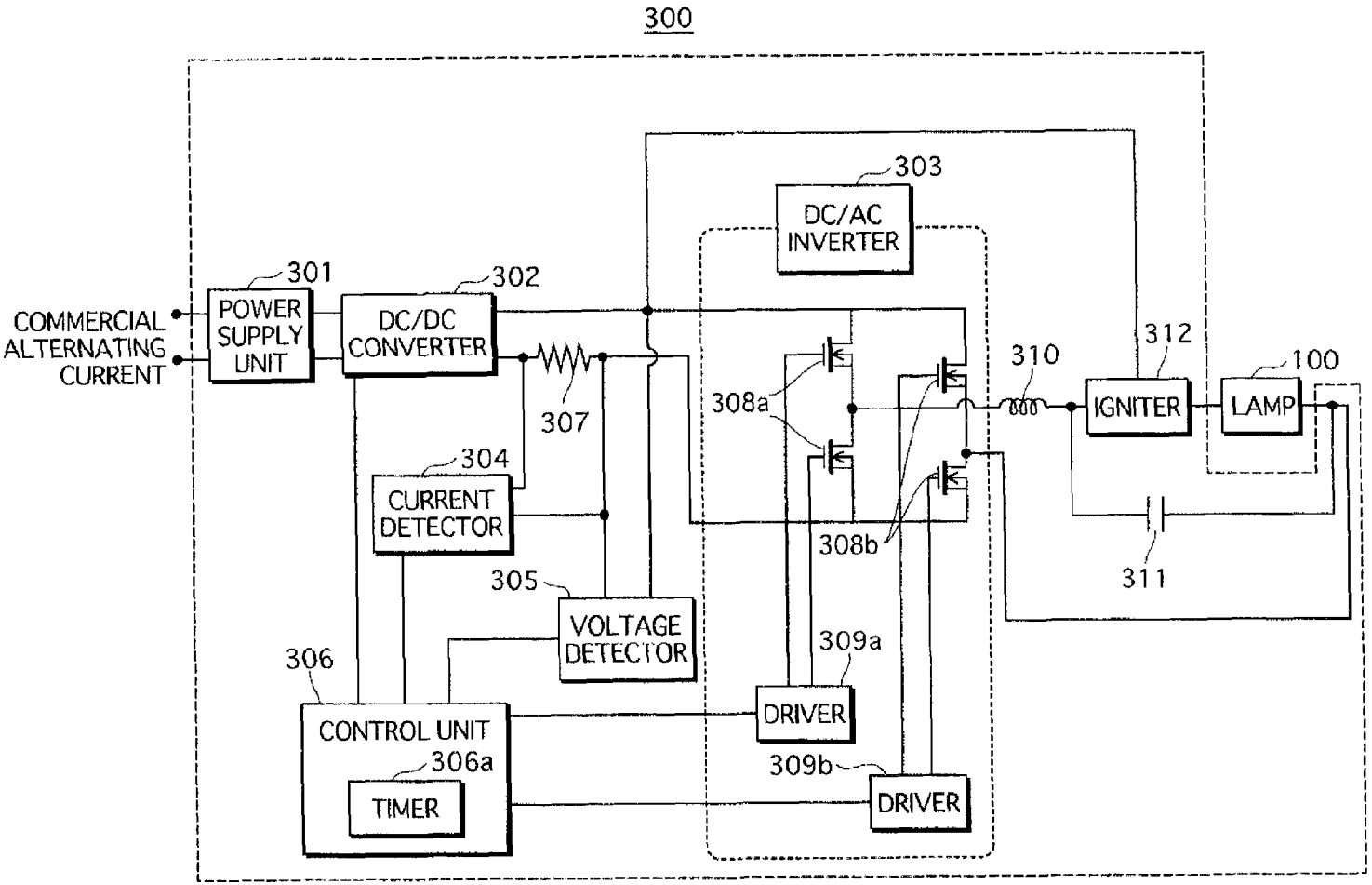

[Fig. 4]
(a)
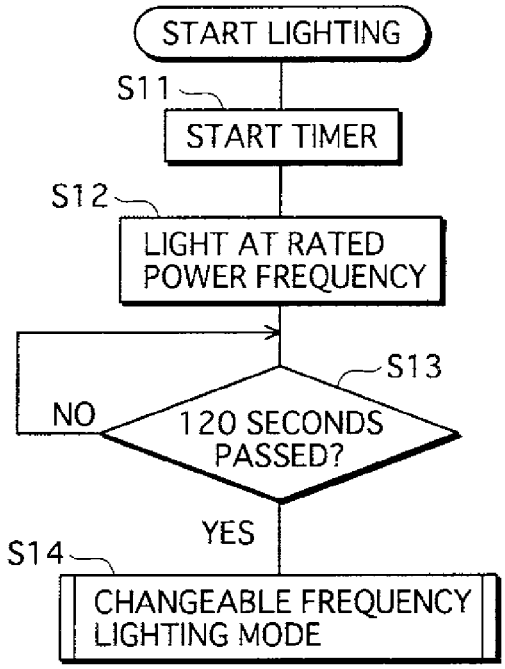
(b)
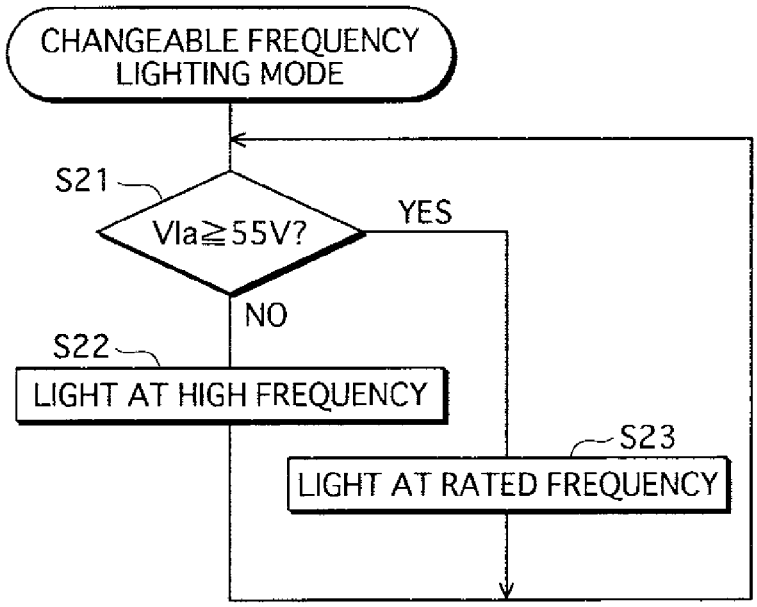

[Fig. 5]
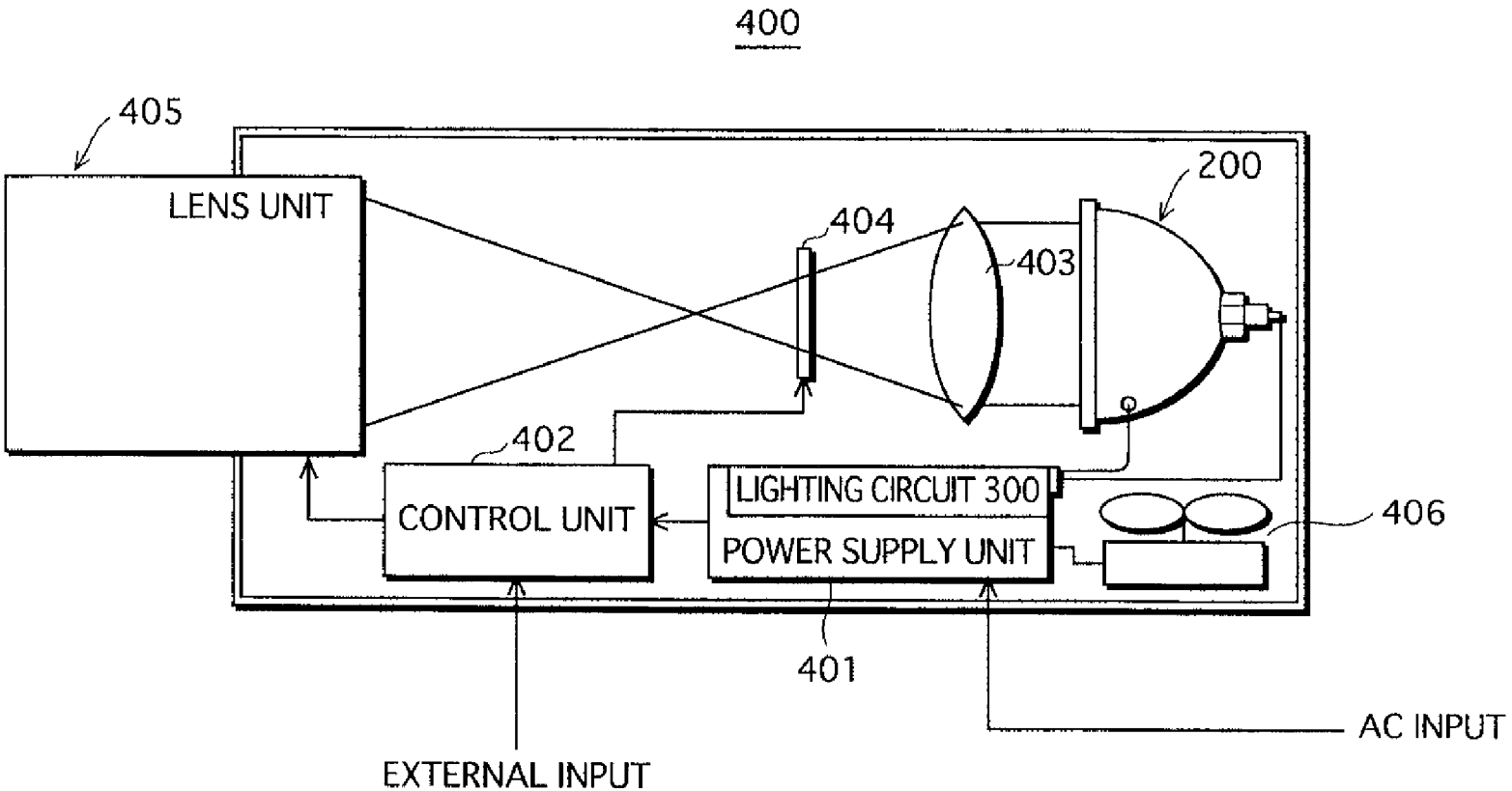

[Fig. 6]
(a)
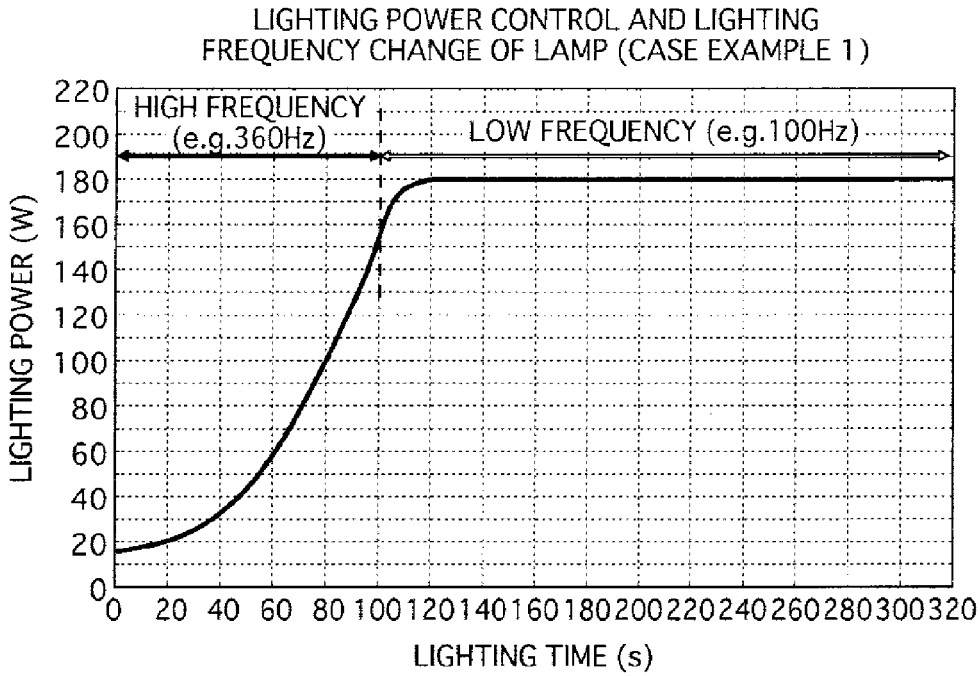
(b)
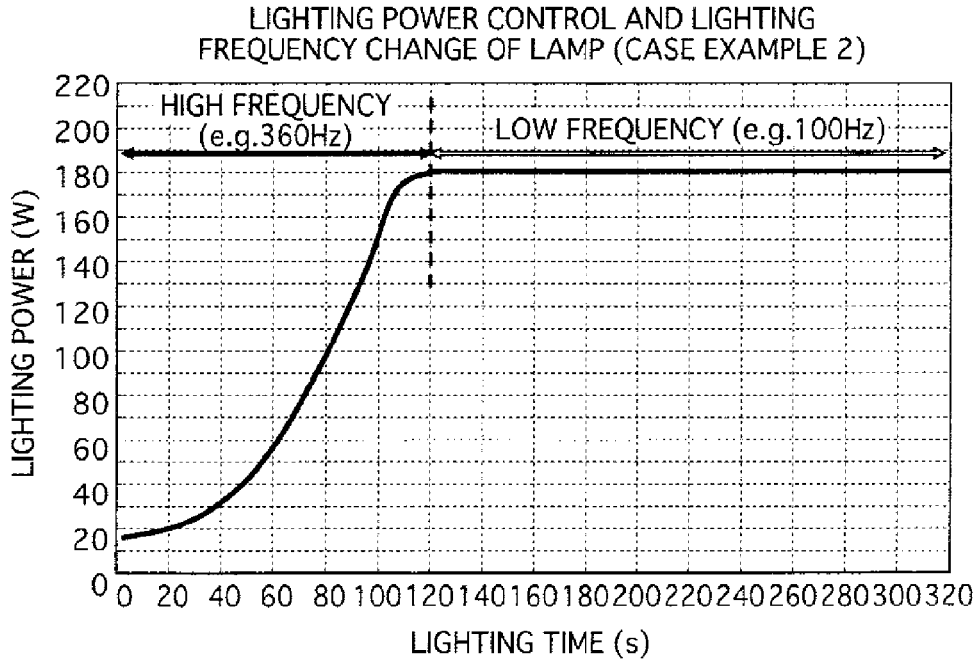

[Fig. 7]
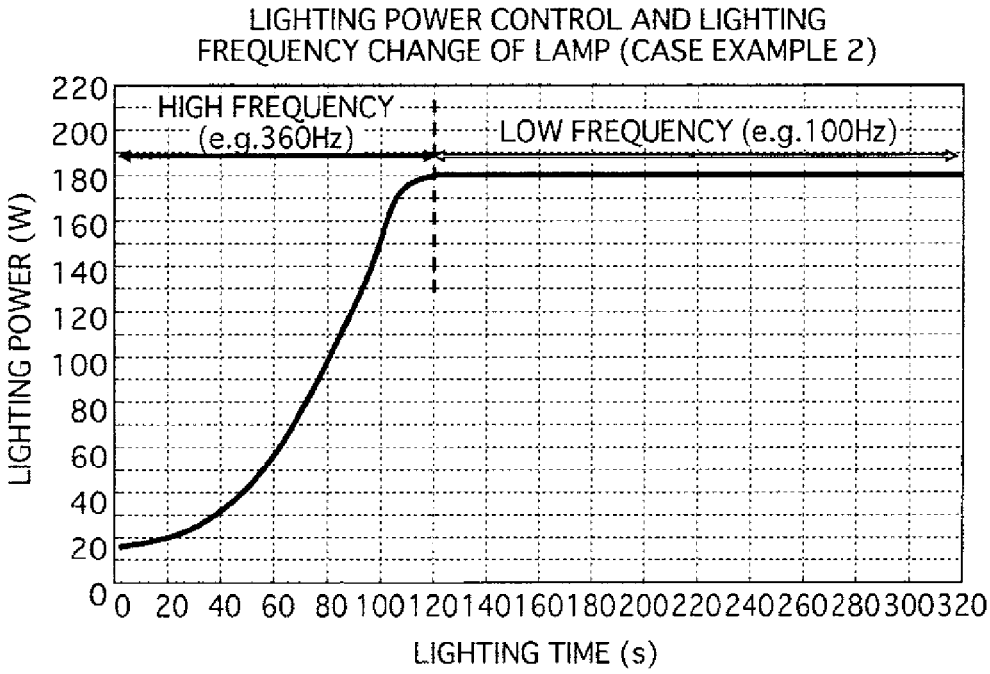

[Fig. 8]
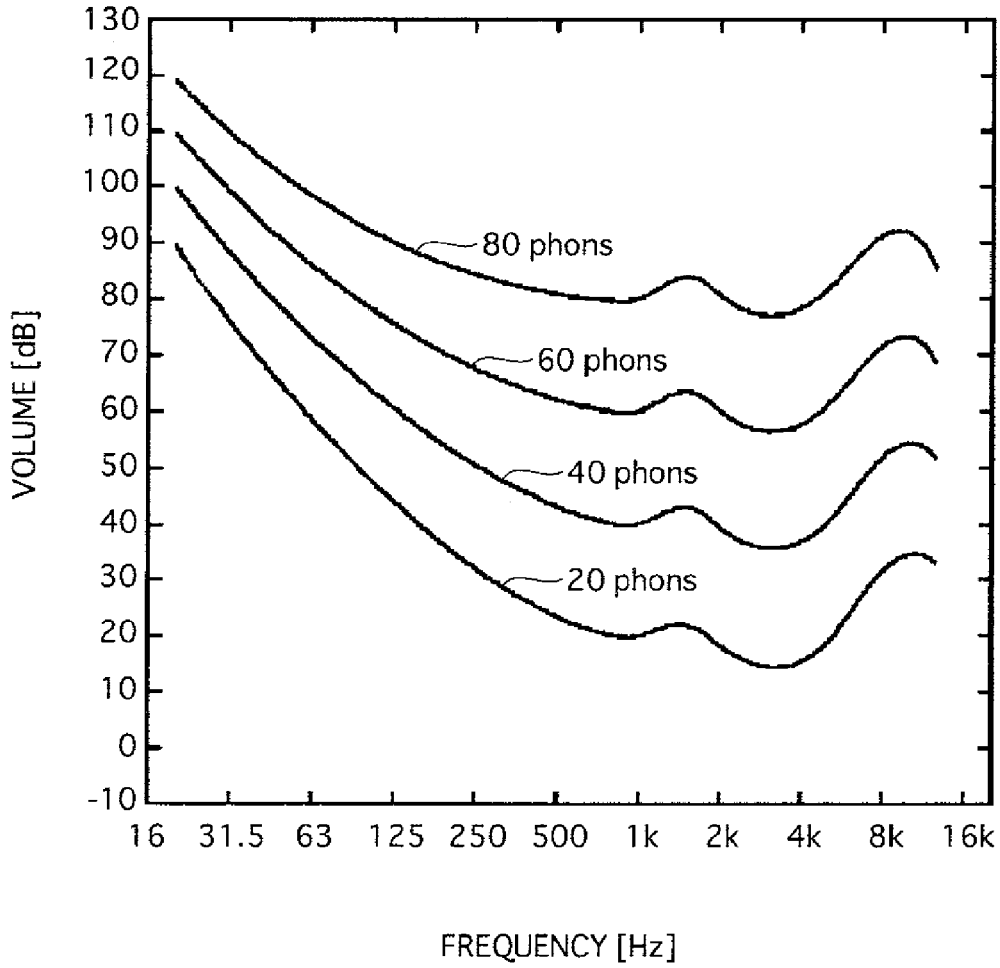

LIGHTING METHOD FOR A HIGH-PRESSURE DISCHARGE LAMP, LIGHTING CIRCUIT FOR A HIGH-PRESSURE DISCHARGE LAMP, HIGH-PRESSURE DISCHARGE LAMP APPARATUS, AND PROJECTOR-TYPE IMAGE DISPLAY APPARATUS

TECHNICAL FIELD

The present invention relates to a lighting method for a high-pressure discharge lamp, a lighting circuit for a high-pressure discharge lamp, a high-pressure discharge lamp apparatus, and a projector-type image display apparatus.

BACKGROUND ART

A high-pressure discharge lamp is used as a light source in a projector-type image display apparatus such as a liquid crystal projector.

The high-pressure discharge lamp has a pair of opposing electrodes disposed inside an arc tube enclosing, for example, a halogen material, a noble gas, and mercury. As a lighting method, a predetermined high voltage is applied to the high-pressure discharge lamp to cause dielectric breakdown between the electrodes, and subsequently an alternating current of a predetermined frequency is caused to flow.

To lengthen the life of the lamp, a technology is known for controlling the shape of the electrodes as appropriate by switching the frequency of the alternating current while the lamp is lit (for example, see patent citation 1).

Patent Citation 1: Patent 2003-338394

DISCLOSURE OF INVENTION

Problems Solved by the Invention

However, according to the observations of the inventors of the present invention, depending on a frequency value after the switch, there are cases in which noise is generated by electronic components and the like of the high-pressure discharge lamp lighting apparatus.

In a liquid crystal projector, suppressing noise from the lighting apparatus as much as possible is necessary for realizing a comfortable listening environment. In particular, noise suppression is highly sought after in liquid crystal projectors that project video along with audio.

If the frequency is not switched, though the generation of noise can be reduced, in this case the shape of the electrodes cannot be controlled, which leads to a shortening of the life of the lamp.

The present invention has been achieved in view of the above problem, and an aim thereof is to provide a lighting method for a high-pressure discharge lamp that is as quiet as possible and that firmly maintains control of the shape of the electrodes by switching the frequency.

Means to Solve the Problems

In order to achieve the above aim, one aspect of the present invention is a lighting method for a high-pressure discharge lamp that has a halogen material enclosed therein, and includes an arc tube having a pair of electrodes disposed therein, each of the electrodes having a protuberance formed on an end thereof, the lighting method being for lighting the high-pressure discharge lamp by a supply of an alternating current, performing constant current control after a startup, and thereafter changing to lighting at a constant power, the lighting method including: a switching step of switching a frequency of the alternating current, in accordance with a change in a voltage value between the pair of electrodes, from a first value that is a rated frequency to a second value that is different from the first value and that has a higher degree of audibility than the first value; and a maintenance step of prohibiting the switching step and maintaining the frequency of the alternating current at the first value during a period that is one of (i) a predetermined time period that starts at the startup of the high-pressure discharge lamp and ends before the change to lighting at the constant power, (ii) a time period from the startup to a time of the change to lighting at the constant power, and (iii) a time period that begins at the startup and ends when a predetermined time period after the change to lighting at the constant power has elapsed.

Another aspect of the present invention is a lighting method for a high-pressure discharge lamp that has a halogen material enclosed therein, and includes an arc tube having a pair of electrodes disposed therein, each of the electrodes having a protuberance formed on an end thereof, the lighting method being for lighting the high-pressure discharge lamp by a supply of an alternating current, performing constant current control after a startup, and thereafter changing to lighting at a constant power, the lighting method including: a switching step of switching a frequency of the alternating current, in accordance with a change in a voltage value between the pair of electrodes, from a first value that is a rated frequency to a second value that is different from the first value and that has a higher degree of audibility than the first value; and a maintenance step of prohibiting the switching step and maintaining the frequency of the alternating current at the first value during a period from 60 seconds to 300 seconds, inclusive, from the startup.

Another aspect of the present invention is a lighting circuit for a high-pressure discharge lamp that has a halogen material enclosed therein, and includes an arc tube having a pair of electrodes disposed therein, each of the electrodes having a protuberance formed on an end thereof, the lighting circuit being for lighting the high-pressure discharge lamp by a supply of an alternating current, performing constant control after a startup, and thereafter changing to lighting at a constant power, the lighting circuit including: a switching unit operable to switch a frequency of the alternating current, in accordance with a change in a voltage value between the pair of electrodes, from a first value that is a rated frequency to a second value that is different from the first value and that has a higher degree of audibility than the first value; and a maintenance unit operable to prohibit the switching, and maintain the frequency of the alternating current at the first value during a period that is one of (i) a predetermined time period that starts at the startup of the high-pressure discharge lamp and ends before the change to lighting at the constant power, (ii) a time period from the startup to a time of the change to lighting at the constant power, and (iii) a time period that begins at the startup and ends when a predetermined time period after the change to lighting at the constant power has elapsed.

Another aspect of the present invention is a lighting circuit for a high-pressure discharge lamp that has a halogen material enclosed therein, and includes an arc tube having a pair of electrodes disposed therein, each of the electrodes having a protuberance formed on an end thereof, the lighting circuit being for lighting the high-pressure discharge lamp by a supply of an alternating current, performing constant control after a startup, and thereafter changing to lighting at a constant power, the lighting circuit including: a switching unit operable to switch a frequency of the alternating current, in accordance with a change in a voltage value between the pair of electrodes, from a first value that is a rated frequency to a second value that is different from the first value and that has a higher degree of audibility than the first value; and a maintenance unit operable to prohibit the switching, and maintain the frequency of the alternating current at the first value during a period from 60 seconds to 300 seconds, inclusive, from the startup.

Another aspect of the present invention is a high-pressure discharge lamp apparatus, including: a high-pressure discharge lamp; the lighting circuit of one of claims 5, 6, 7, and 8 that lights the high-pressure discharge lamp; and a reflective mirror that reflects light emitted from the high-pressure discharge lamp.

Another aspect of the present invention is a projector-type image display apparatus including the high-pressure discharge lamp apparatus of claim 9.

Effects of the Invention

According to the structures described in the means to solve the problem, maintaining the frequency of the alternating current at the first value and prohibiting switching the frequency to the second value that has a higher degree of audibility for a fixed period after startup enables suppressing noise generation due to switching while avoiding frequency switches that do not contribute much to controlling the shape of the electrodes. Also, after the fixed period has passed, switching the frequency, or in other words entering a changeable frequency lighting mode, enables controlling the shape of the electrodes appropriately and therefore lengthening the life of the lamp.

Also, the second value may be higher than the first value, and in the switching step, if the voltage value falls below a predetermined value, the frequency of the alternating current may be switched from the first value to the second value.

Also, the second value may be in a range from 300 Hz to 1000 Hz, inclusive.

BRIEF DESCRIPTION OF THE DRAWINGS

FIG. 1 shows an overall structure of a high-pressure mercury lamp;

FIG. 2 is a perspective view of a structure of a lamp unit that uses the high-pressure mercury lamp (high-pressure discharge lamp apparatus) having one portion cut away;

FIG. 3 shows a structure of a lighting apparatus;

FIGS. 4(*a*) and 4(*b*) are flowcharts showing lighting control processing performed by the lighting apparatus;

FIG. 5 is a block diagram showing a structure of a liquid crystal projector;

FIGS. 6(*a*) and 6(*b*) are graphs that diagrammatically show a relationship between lighting time and power;

FIG. 7 is a graph that diagrammatically shows a relationship between lighting time and power; and FIG. 8 is a graph showing exemplary loudness level curves.

DESCRIPTION OF THE CHARACTERS

100 high-pressure mercury lamp

200 lamp unit (high-pressure discharge lamp apparatus)

300 lighting circuit

305 voltage detector

306 control unit

306*a* timer

400 liquid crystal projector

BEST MODE FOR CARRYING OUT THE INVENTION

1. High-Pressure Discharge Lamp

As an example of a high-pressure discharge lamp, FIG. 1 shows a structure of an alternating current lighting type high-pressure mercury lamp (hereinafter, may be referred to simply as a "lamp") 100 that has a rated power of 150 [W], and for convenience is a sectioned view that exposes electrodes in the lamp.

As shown in FIG. 1, the lamp 100 includes a quartz glass arc tube 101 having a spheroid-shaped light emitting part 101*a*, and sealed parts 101*b* and 101*c* that are formed on both ends of the light emitting part 101*a*.

Mercury 109 as a light-emitting material, a noble gas such as argon, krypton, or xenon for aiding start-up, and iodine or bromine for realizing the halogen cycle or a halogen material that is a compound of these, are enclosed in the light emitting part 101*a* in a light emission space 108. In this case, a quantity of the enclosed mercury 109 is set to be in a range of 150 [mg/cm$^3$] to 650 [mg/cm$^3$] per unit volume inclusive in the arc tube 101, and the pressure of the noble gas when the lamp is cool is set to be in a range of 0.01 [MPa] to 1 [MPa] inclusive. Also, the quantity of enclosed bromine is in a range of $1*10^{-10}$ [mol/cm$^3$] to $1*10^{-4}$ [mol/cm$^3$] inclusive, and preferably in a range of $1*10^{-9}$ [mol/cm$^3$] to $1*10^{-5}$ [mol/cm$^3$] inclusive.

Also, a pair of tungsten (W) electrodes 102 and 103 are disposed inside the light emitting part 101*a* so as to be substantially opposing each other.

The distance between the tips of the electrodes 102 and 103, namely an inter-electrode distance De, is set to be in a range of 0.5 [mm] to 2.0 [mm] inclusive. Also, while the lamp is lit, after the tungsten that is the structural material of the electrodes 102 and 103 has evaporated on the tips of the electrodes 102 and 103, the tungsten is deposited again on the tips of the electrodes 102 and 103, in particular on the vertices thereof, due to the action of the halogen cycle, and this deposit naturally forms protuberances 124 and 134 without any mechanical processing being performed. Since the protuberances 124 and 134 indicated here have been caused to form during the lighting phase of the manufacturing process, the protuberances 124 and 134 have already been formed by the time manufacture is complete. The inter-electrode distance De specifically indicates the distance between the protuberances 124 and 134.

The electrodes 102 and 103 are electrically connected to molybdenum foil pieces 104 and 105 that are sealed inside the sealed parts 101*b* and 101*c*.

The molybdenum foil pieces 104 and 105 are connected to molybdenum lead wires 106 and 107 that extend out of the arc tube 101 from respective end surfaces of the sealed parts 101*b* and 101*c*.

2. Lamp Unit

FIG. 2 is a perspective view of the structure of a lamp unit (high-pressure discharge lamp apparatus) 200 that incorporates the lamp 100, having one portion cut away. As shown in FIG. 2, one end of the arc tube 101 of the lamp 100 has a base 201 fitted thereon, and the lamp 100 is fitted into a reflective mirror 203 via a spacer 202 in such a way that the position of the discharge arc has been adjusted so as to match the optical axis of the reflective mirror 203. Power is supplied to one of the electrodes of the lamp 100 via a lead wire 205 that passes through a through-hole 206 pierced through the reflective mirror 203, and power is supplied to the other electrode via a terminal 204.

3. Lighting Circuit

FIG. 3 shows the structure of a lighting circuit 300 that causes the lamp 100 to light.

As shown in FIG. 3, the lighting circuit 300 includes a power supply unit 301, a DC/DC converter 302, a DC/AC inverter 303, a current detector 304, a voltage detector 305, a control unit 306, a current sensing resistor 307, MOS-FETs 308*a* and 308*b*, MOS-FET drivers 309*a* and 309*b*, a resonance coil 310, a resonance capacitor 311, and an igniter 312.

For example, the power supply unit 301 includes a rectifying circuit, and generates direct current from domestic-use 100 V alternating current.

The DC/DC converter 302 receives a PWM (Pulse Width Modulation) control signal from the control unit 306, and supplies a predetermined amount of direct current to the DC/AC inverter 303. Specifically, stable-state lighting (steady-state lighting) requires performing control to stabilize the lamp power to maintain the light output of the high-pressure mercury lamp 100 at a constant rate (constant power control). For this reason, the control unit 306 calculates the lamp power with use of an internal microcomputer based on a lamp current detected by the current detector 304 and a lamp voltage detected by the voltage detector 305, and sends a PWM control signal for stabilizing the lamp power to the DC/DC converter 302. The DC/DC converter 302 receives the PWM control signal and converts the direct current from the power supply unit 301 to a predetermined amount of direct current. However, while the lamp is in a low voltage state (i.e., a high current state) from the startup of the lamp 100 until the lamp 100 lights up, the control unit 306 sends the PMW control signal to the DC/DC converter 302 for performing constant current control.

The DC/AC inverter 303 generates square-wave alternating current having a predetermined frequency in accordance with the control signal transmitted from the control unit 306, and supplies the square-wave alternating current to the lamp 100.

The igniter 312 includes a transformer, for example. During startup, the igniter 312 generates and applies a high-pressure pulse to the lamp 100.

The control unit 306 is constituted basically from a microcomputer in the center, and performs overall control of the DC/DC converter 302, the DC/AC inverter 303, etc.

The current detector 304 and the voltage detector 305 detect the current and the voltage of the lamp 100, respectively.

Also, the control unit 306 performs fixed control at a rated frequency without switching the drive frequency of the MOS-FETs 308*a* and 308*b* of the DC/AC inverter 303 for a predetermined time period after the startup (as measured by a timer 306*a*). After the predetermined time period has passed, in accordance with a value detected by the voltage detector 305 as appropriate, the control unit 306 switches a drive frequency of the MOS-FETs 308*a* and 308*b* to a predetermined frequency, in other words, executes a switching step that is described later.

4. Example of Lighting Operation

Next, a specific example of a lighting operation is described with use of the flowcharts of FIGS. 4(*a*) and 4(*b*). The startup, which is described later, is omitted from the flowcharts of FIGS. 4(*a*) and 4(*b*).

(1) First, when a lighting switch (not depicted) is turned on to cause the lamp 100 to start discharge, a current having a high frequency, such as 3 [kV], and a high voltage, such as 100 [kHz], is applied to the lamp 100 by the igniter 312.

(2) When breakdown occurs between the electrodes 102 and 103 in the lamp 100, a high-frequency arc discharge current starts to pass between the electrodes 102 and 103. In other words, the lamp 100 starts discharge. The high-frequency output continues to be applied to the lamp 100 for a fixed time period even after the discharge starts. Thereafter, as a warm-up period for the electrodes 102 and 103 that further stabilizes the discharge, lighting by constant current control (i.e. high-frequency operation) is maintained for, for example, a period of 2 [s]. In this period of 2 [s], a high frequency current selected within a range of 10 [kHz] to 500 [kHz] inclusive is maintained. When the 2 [s] have passed, the high-frequency operation ends at the same time, and the so-called startup ends.

Note that in the startup described above, the output from the igniter 312 for starting the discharge of the lamp 100 is not limited to being high frequency and high voltage, and a conventional blocking oscillator-type high-voltage pulse may be used instead. Also, the method of stabilizing the arc discharge after discharge starts is not limited to being the high-frequency operation, and may instead be a known direct current operation or a constant current control operation using a low frequency current under 20 [Hz].

(3-1) After the startup, there is a change to lighting (at a 3 [A] constant, for example) by constant current control using substantially square-wave current (hereinafter referred to as a "low-frequency operation"). Although the 3 [A] constant is given as an example, here the "constant current control" indicates not only control to make the current value constant, but also all overall control for placing restrictions on the current to prevent excess current from flowing into the lamp 100 when the lamp 100 is in a low voltage state before lighting up (the same is true for all cases below).

The control unit 306 performs the constant current control (at the 3 [A] constant, for example) until the lamp voltage increases to reach a predetermined voltage (for example, 55 [V]) as the mercury evaporates, and meanwhile performs lighting detection with use of a signal indicating the lamp current detected by the current detector 304, and judges whether startup has been performed. Then, as shown in FIG. 4(*a*), at the same time as the change to the low-frequency operation, the timer 306*a* starts counting (S11), and an alternating current fixed at a rated frequency of, for example, 150 [Hz], is supplied to the lamp 100 (S12). Here, the timer time period of the timer 306*a* is set at, for example, 100 [s], and until the 100 [s] timer time period has passed, the later-described "switching step" is prohibited, and the alternating current supply is maintained at the constant frequency (150 [Hz]) (S13: NO). As shown in FIG. 6(*a*), the timer time period 100 [s] is set as a predetermined time period that starts at the startup (cold start) and ends before the change to lighting at the constant power (150 [W]). Of course, as described later, in view of making the lamp as quiet as possible, the "predetermined time period" "that starts at the startup and ends before the change to lighting at the constant power" is preferably long, and as a lower limit, for example should preferably be greater than or equal to 60 [s] from the startup. The time period from the startup to the time of the change to lighting at the constant power (150 [W]) is a fixed value that is determined in the specifications of the lamp 100, and is obtained by performing numerous experiments, and is 120 [s] here. In actual practice, the length of the time period from the startup to the time of the change to lighting at the constant power varies among individual lamps 100, and is also influenced by various conditions, such as the lamps 100 being started by a hot start. However, such variations are not large, and do not influence the effects described below.

Note that the alternating current that is supplied to the lamp 100 in the present embodiment is specifically a substantially square-wave current. Here, "substantially square-wave current" encompasses not only a current that is entirely composed of square waves, but also a square-wave current that has been distorted due to overshoot or the like. Also, another type of alternating current waveform is known in a conventional lighting method for suppressing the luminescent spot movement of the arc of the lamp 100. In this method, superimposing pulse currents before polarity inversion at every half cycle of the square-wave current, or causing the current values to slope higher over time at every half cycle of the square wave current causes one cycle to be added to the frequency immediately before or immediately after the polarity inversion at each half cycle of the square wave current. The alternating current waveform is formed so that only the lamp current in the latter half-cycle of the added waveform is higher than the current value immediately before the addition. These types of alternating currents are also considered "substantially square-wave currents". Here, the frequency of the substantially square-wave current indicates the frequency of the square-wave current considered as a baseline reference.

Also, FIG. 6(*a*) shows a lighting time [s] on a horizontal axis, and a lamp power [W] on a vertical axis. The same is true in later-described FIGS. 6(*b*) and 7.

(4-1) When the count of the timer 306*a* reaches 100 [s] (S13: YES), a changeable frequency lighting mode (S14) starts. The changeable frequency lighting mode is maintained thereafter until the lamp is extinguished (the light switch is turned off). Meanwhile, as shown in FIG. 6(*a*), independently of the count of the timer 306*a*, when the lamp voltage rises to reach a predetermined voltage value (for example 55 [V]), constant power control that fixes the lamp power at a constant (150 [W]) starts. Specifically, the control unit 306 controls the output current of the DC/DC converter 302 by calculating the lamp power with use of the microcomputer in accordance with the current value detected by the current detector 304 and the voltage value detected by the voltage detector 305, and sending a PWM control signal to the DC/DC converter to maintain the constant power.

As shown in FIG. 4(*b*), in the changeable frequency lighting mode, if the lamp voltage (Vla) is greater than or equal to 55 [V] (S21: YES), the lamp is lit using the rated frequency of 150 [Hz] as the frequency of the alternating current supply, and the rated frequency is maintained. If the lamp voltage falls below 55 [V] (S21: NO), the frequency is switched to a higher and more audible frequency than the rated frequency 150 [Hz], for example, 400 [Hz], and this is the switching step (S22). Thereafter, if the lamp voltage becomes greater than or equal to 55 [V] (S21: YES), the lamp is lit at the rated frequency of 150 [Hz], and the rated frequency is maintained.

The period in which the "switching step" is prohibited is not limited to being the above-described "time period that starts at the startup and ends before the change to lighting at the constant power", and may also be, for example as shown in FIG. 6(*b*), "a time period from the startup to the time of the change to lighting at the constant power" or "a time period that begins at the startup and ends when a predetermined time period after the change to lighting at the constant power has elapsed", or for example, as shown in FIG. 7, 160 [s] after the startup. Such variations are described in detail below.

Variation 1

(3-2) In the operation example shown in FIG. 6(*b*), after the above-described steps in (1) and (2), specifically after the startup, there is also a change to the low-frequency operation. The control unit 306 performs the constant current control (at the 3 [A] constant, for example) until the lamp voltage increases to reach a predetermined voltage (for example, 55 [V]) as the mercury evaporates. During this time, the frequency of the alternating current supply is not switched, and is held constant at the rated frequency of 150 [Hz].

(4-2) Thereafter, unlike step (3-1) in the operation example shown in FIG. 6(*a*), as shown in FIG. 6(*b*), operation switches to the changeable frequency lighting mode that includes the switching step when the time period from startup until the lamp voltage reaches the predetermined value (for example 55 [V]), has elapsed. This occurs at the same time as the change to constant power control for stabilizing the lamp power.

Variation 2

(3-3) In the operation example shown in FIG. 7, there is also a change to the low-frequency operation after the above-described steps in (1) and (2), specifically after the startup. The control unit 306 performs the constant current control (at the 3 [A] constant, for example) until the lamp voltage increases to reach a predetermined voltage (for example, 55 [V]) as the mercury evaporates. Then, at the same time as the startup, the timer 306*a* starts to count, and an alternating current that is fixed at the rated frequency of 150 [Hz] is supplied to the lamps 100. Here, the timer time period of the timer 306*a* is set at, for example, 160 [s]. Until the timer time period of 160 [s] has passed, the switching step is prohibited, and the frequency of the alternating current supply is maintained at the rated frequency of (150 [Hz]). As shown in FIG. 7, the timer time period of 160 [s] has been set as a predetermined time period that starts at the change to lighting at the constant power (150 [W]) which is after the startup (cold start). Of course, as described later, the "predetermined time period" "that starts at the change to lighting at the constant power which is after the startup", as described later, from the standpoint of adequately lengthening and maintaining the protuberances 124 and 134 of the electrodes 102 and 103, is preferably not very long, and is preferably less than or equal to 300 [s] from the startup, for example, as an upper limit.

(4-3) When the count of the timer 306*a* reaches 160 [s], operation switches to the changeable frequency lighting mode, and the changeable frequency lighting mode is maintained thereafter until the lamp is extinguished (the light switch is turned off).

As shown in FIG. 7, independently of the count of the timer 306*a*, when the lamp voltage rises to reach a predetermined voltage value (for example 55 [V]), there is a change to constant power control that stabilizes the lamp power (at 150 [W]).

Here, a decrease in the lamp voltage value is an indicator of a shortening of the inter-electrode distance De. The shortening of the inter-electrode distance De basically occurs as a result of the halogen cycle when the electrode material that has evaporated is locally deposited on the ends of the electrodes 102 and 103, and the protuberances 124 and 134 lengthen.

Switching the frequency of the supplied alternating current to a higher frequency, for example 400 [Hz], enables suppressing (or eliminating) the lengthening of the protuberances 124 and 134, and adequately preserving the inter-electrode distance De. Note that the high frequency is preferably in a range from 300 [Hz] to 1000 [Hz] inclusive, and as a result is a frequency with a high degree of audibility.

Although switching the frequency in this way is generally effective for control of the electrode shape, the frequency switch is not considered effective during the predetermined period after the startup.

The predetermined period after the startup in which the control of the electrode shape is not effectively realized by the changeable frequency lighting mode is one selected from among the alternatives described above, namely (1) a predetermined time period that starts at the startup and ends before the change to lighting at the constant power (see FIG. 6(*a*)), (2) a time period from the startup to a time of the change to lighting at the constant power (see FIG. 6(*b*)) and (3) a predetermined time period that starts at the change to lighting at the constant power which is after the startup (see FIG. 7).

After the startup, constant current control is performed, and as the vapor pressure of the enclosed mercury rises, the lamp voltage also rises. Thereafter, there is a change to constant power lighting when the predetermined lamp voltage is reached. In other words, during (1) the predetermined time period that starts at the startup and ends before the change to lighting at the constant power, and (2) the time period from the startup to a time of the change to lighting at the constant power, since the mercury in the light emission space 108 of the lamp 100 is in the process of evaporating, the lamp voltage is low. For this reason, if the timer control (S11, S13) is eliminated, as in conventional methods, high frequency lighting is performed every time independently of whether the inter-electrode distance De has shortened. If high frequency lighting is performed regardless of the difficulty of achieving the effect of controlling the shape of the electrodes, there are cases in which the electronic components of the lighting circuit 300 and the lead wire of the lamp 100 generate noise. Particularly when constant current control is performed while the lamp voltage is low, since the value of the constant current at this time is higher than the value of the current at the time of lighting at the constant power, there is likely to be a large quantity of noise. In view of this, the generation of noise is suppressed by prohibiting switching to a higher and more audible frequency during such periods.

Additionally, in (3) the predetermined time period that starts at the change to lighting at the constant power which is after the startup, the lamp voltage is normally not low, and is above a certain level. However, since after the constant current control, the lamp current is higher than the lamp current at the time of constant power lighting, the temperature of the electrodes 102 and 103 is higher than normal. Accordingly, due to the shortening of the inter-electrode distance De, there is practically no risk of the lamp voltage becoming low while in this state. Therefore, it is also difficult to realize the effect of control of the electrode shape during (3) the predetermined time period that starts at the change to lighting at the constant power which is after the startup. However, although the cause is unknown, for about 1 to 3 minutes (generally between 60 [s] and 180 [s]), due to an unknown factor that at least is not the electrode shape, the discharge state destabilizes, the lamp voltage decreases, and unnecessary switches in frequency are known to occur in some lamps 100. In view of this, this period is also considered one of the options for the period in which switching the frequency is prohibited.

Note that although the time from the startup period to the change to lighting at a constant power depends on the specifications of the lamp (number of watts of rated power, quantity of enclosed mercury, etc.), by performing numerous experiments, generally a range has been obtained that is from 60 [s] to 240 [s] after lighting starts.

By performing experiments from this perspective, the period in which the effect of controlling the electrode shape is difficult to achieve, namely the period in which switching the frequency is prohibited (switching step prohibited period), was found to be preferably in a range of 60 [s] to 300 [s] inclusive from the startup.

5. Liquid Crystal Projector

The lamp unit 200 described above can be incorporated in a projector-type image display apparatus.

FIG. 5 shows an overall structure of a liquid crystal projector 400 as an example of the projector-type image display apparatus.

As shown in FIG. 5, the transmission-type liquid crystal projector 400 includes a power supply unit 401, a control unit 402, a condensing lens 403, a transmission-type color liquid crystal display panel 404, a lens unit 405 that houses a drive motor, and a cooling fan 406.

The power supply unit 401 converts a commercial alternating current input (100 V) to a predetermined direct current voltage, and supplies the direct current voltage to the control unit 402. Note that the power supply unit 401 may have the same structure as the power supply unit 301 of the lighting circuit 300 (see FIG. 3).

In accordance with an image signal input by an external device, the control unit 402 drives the color liquid crystal display panel 404 and causes a color image to be displayed. Also, focusing and zooming are performed by adjusting the lens unit 405.

Light emitted from the lamp unit 200 is condensed by the condensing lens 403 and transmitted through the color liquid crystal display panel 404 disposed in the optical path. Then, via the lens unit 405, the light causes the image formed on the liquid crystal display panel 404 to be projected on a screen, which is not depicted.

Note that the lamp unit 200 that includes the lighting apparatus 300 of the lamp of the present invention is also applicable to DLP (trademark) type projectors that use a DMD (digital micromirror device), liquid crystal projectors that use other reflective type liquid crystal elements, and other types of projector-type image display apparatuses.

Supplementary Remarks (1) Frequency when Lamp Voltage Value Vla Decreases

When the lamp voltage value Vla decreases as the inter-electrode distance shortens, an example was given in the above description of selecting a frequency in a range from 300 [Hz] to 1000 [Hz] inclusive. However, instead of the above frequency range, a frequency less than or equal to 60 [Hz] (not including 0 [Hz]) is also known to be effective in suppressing the lengthening of the protuberances 124 and 134. At this time, although a prohibition against switching the frequency may not be necessary since the frequency is low, the prohibition may be used without causing any difficulty.

(2) Frequencies to which Switching Should be Prohibited

There are cases in which switching the frequency to an audible frequency (generally to a frequency in a range of about 20 [Hz] to 20,000 [Hz] inclusive), and particularly switching to a more highly audible frequency, leads to generation of noise that is likely to bother the user.

The degree of audibility can be determined, for example, based on the loudness level curves shown in FIG. 8. Note that an indicator stipulated in ISO 226 may also be used.

The curves in FIG. 8 show that the degree of audibility increases in proportion to the frequency until the frequency is approximately 1 [kHz] (1000 [Hz]). According to these curves, for example switching from 150 [Hz] to 400 [Hz], and from 200 [Hz] to 1000 [Hz], are switches to a higher degree of audibility.

(3) Number of Frequency Values Switched Between

In the changeable frequency lighting mode, although switching between two frequency values is described as an example in the above description, switching may be performed between three or more frequency values.

INDUSTRIAL APPLICABILITY

A high-pressure discharge lamp lighting apparatus of the present invention is quieter than conventional lamps, and therefore is suitable for use in a liquid crystal display apparatus or the like.

The invention claimed is:

1. A lighting method for a high-pressure discharge lamp that has a halogen material enclosed therein, and includes an arc tube having a pair of electrodes disposed therein, each of the electrodes having a protuberance formed on an end thereof, the lighting method being for lighting the high-pressure discharge lamp by a supply of an alternating current, performing constant current control after a startup, and thereafter changing to lighting at a constant power, the lighting method comprising:

a switching step of switching a frequency of the alternating current, in accordance with a change in a voltage value between the pair of electrodes, from a first value that is a rated frequency to a second value that is different from the first value and that has a higher degree of audibility than the first value; and a maintenance step of prohibiting the switching step and maintaining the frequency of the alternating current at the first value during a period that is one of (i) a predetermined time period that starts at the startup of the high-pressure discharge lamp and ends before the change to lighting at the constant power, (ii) a time period from the startup to a time of the change to lighting at the constant power, and (iii) a time period that begins at the startup and ends when a predetermined time period after the change to lighting at the constant power has elapsed.

2. A lighting method for a high-pressure discharge lamp that has a halogen material enclosed therein, and includes an arc tube having a pair of electrodes disposed therein, each of the electrodes having a protuberance formed on an end thereof, the lighting method being for lighting the high-pressure discharge lamp by a supply of an alternating current, performing constant current control after a startup, and thereafter changing to lighting at a constant power, the lighting method comprising:

a switching step of switching a frequency of the alternating current, in accordance with a change in a voltage value between the pair of electrodes, from a first value that is a rated frequency to a second value that is different from the first value and that has a higher degree of audibility than the first value; and a maintenance step of prohibiting the switching step and maintaining the frequency of the alternating current at the first value during a period from 60 seconds to 300 seconds, inclusive, from the startup.

3. The lighting method of claim 1, wherein the second value is higher than the first value, and in the switching step, if the voltage value falls below a predetermined value, the frequency of the alternating current is switched from the first value to the second value.

4. The lighting method of claim 3, wherein the second value is in a range from 300 Hz to 1000 Hz, inclusive.

5. A lighting circuit for a high-pressure discharge lamp that has a halogen material enclosed therein, and includes an arc tube having a pair of electrodes disposed therein, each of the electrodes having a protuberance formed on an end thereof, the lighting circuit being for lighting the high-pressure discharge lamp by a supply of an alternating current, performing constant control after a startup, and thereafter changing to lighting at a constant power, the lighting circuit comprising:

a switching unit operable to switch a frequency of the alternating current, in accordance with a change in a voltage value between the pair of electrodes, from a first value that is a rated frequency to a second value that is different from the first value and that has a higher degree of audibility than the first value; and a maintenance unit operable to prohibit the switching, and maintain the frequency of the alternating current at the first value during a period that is one of (i) a predetermined time period that starts at the startup of the high-pressure discharge lamp and ends before the change to lighting at the constant power, (ii) a time period from the startup to a time of the change to lighting at the constant power, and (iii) a time period that begins at the startup and ends when a predetermined time period after the change to lighting at the constant power has elapsed.

6. A lighting circuit for a high-pressure discharge lamp that has a halogen material enclosed therein, and includes an arc tube having a pair of electrodes disposed therein, each of the electrodes having a protuberance formed on an end thereof, the lighting circuit being for lighting the high-pressure discharge lamp by a supply of an alternating current, performing constant control after a startup, and thereafter changing to lighting at a constant power, the lighting circuit comprising:

a switching unit operable to switch a frequency of the alternating current, in accordance with a change in a voltage value between the pair of electrodes, from a first value that is a rated frequency to a second value that is different from the first value and that has a higher degree of audibility than the first value; and a maintenance unit operable to prohibit the switching, and maintain the frequency of the alternating current at the first value during a period from 60 seconds to 300 seconds, inclusive, from the startup.

7. The lighting circuit of claim 5, wherein the second value is higher than the first value, and if the voltage value falls below a predetermined value, the switching unit switches the frequency of the alternating current from the first value to the second value.

8. The lighting circuit of claim 7, wherein the second value is in a range from 300 Hz to 1000 Hz, inclusive.

9. A high-pressure discharge lamp apparatus, comprising:

a high-pressure discharge lamp;

the lighting circuit of claim 5 that lights the high-pressure discharge lamp; and a reflective mirror that reflects light emitted from the high-pressure discharge lamp.

10. A projector-type image display apparatus including the high-pressure discharge lamp apparatus of claim 9.

11. The lighting method of claim 2, wherein the second value is higher than the first value, and in the switching step, if the voltage value falls below a predetermined value, the frequency of the alternating current is switched from the first value to the second value.

12. The lighting circuit of claim 6, wherein the second value is higher than the first value, and if the voltage value falls below a predetermined value, the switching unit switches the frequency of the alternating current from the first value to the second value.

13. The lighting method of claim 2, wherein the second value is in a range from 300 Hz to 1000 Hz, inclusive.

14. The lighting circuit of claim 8, wherein the second value is in a range from 300 Hz to 1000 Hz, inclusive.

* * * * *